US006757642B1

(12) United States Patent
Boudreau et al.

(10) Patent No.: US 6,757,642 B1
(45) Date of Patent: Jun. 29, 2004

(54) METHOD FOR PERFORMING WEDGE ANALYSIS FOR ASSESSING WEDGE INSTABILITIES IN UNDERGROUND OPENINGS

(75) Inventors: Samantha Jane Boudreau, Hanmer (CA); Mark Stephen Diederichs, Waterloo (CA); Douglas Jean Hutchinson, Waterloo (CA)

(73) Assignee: Inco Limited, Toronto (CA)

( * ) Notice: Subject to any disclaimer, the term of this patent is extended or adjusted under 35 U.S.C. 154(b) by 777 days.

(21) Appl. No.: 09/709,828

(22) Filed: Nov. 10, 2000

(51) Int. Cl.[7] ..... G01N 33/24

(52) U.S. Cl. ..... 703/1; 73/783; 73/784; 73/787; 73/859

(58) Field of Search ..... 703/1; 73/768, 73/784, 787, 783, 859

(56) References Cited

U.S. PATENT DOCUMENTS 3,796,091 A * 3/1974 Serata ..... 73/784
4,346,600 A * 8/1982 Johnson et al. ..... 73/768
4,641,520 A * 2/1987 Mao ..... 73/152.58
6,311,564 B1 * 11/2001 Martin et al. ..... 73/787

OTHER PUBLICATIONS

Diederichs, M.S.; Kaiser, P.K., "Tensile Strength and Abutment Relaxation as Failure Control Mechanisms in Underground Encavations", *Intl. Journal of Rock Mechanics and Mining Sciences* 36, 1999, Pergamon Press Ltd., London, pp. 71–94.

Brady, B.H.G.; Brown, E.T., *Rock Mechanics for Underground Mining* 2nd ed., Chapman & Hall, London, 1993, pp. 234–250.

Sofianos, A.I., "Stability of Rock Wedges in Tunnel Roofs" *Intl. Journal Rock Mechnanics, Mineral Science and Geomechanics*, vol. 23, No. 2, Pergamon Press Ltd., London, 1986, pp. 119–130.

Barton, N.; Lien, R.; Lunde, J., "Engineering Classification of Rock Masses for the Design of Tunnel Supports" *Rock Mechanics*, vol. 6, No. 4, Springer–Verlag, 1974, pp. 189–236.

Crawford, A.M.; Bray J.W., "Influence of the in–Situ Stress Field and Joint Stiffness on Rock Wedge Stability in Underground Openings", *Canadian Geotechnical Journal*, vol. 20, Toronto, 1983, pp. 276–287.

* cited by examiner

*Primary Examiner*—Albert W. Paladini
(74) *Attorney, Agent, or Firm*—Edward A. Steen

(57) ABSTRACT

A method is provided for performing wedge analysis for assessing wedge occurrence and instability in underground openings, such as mines, caves, and the like. The method scales full-span wedge predictions, accounting for both occurrence and instability potential of possible wedge geometries. The method also generates predictions for wedge failure potential and support demand to result in more economical support design for wedges.

13 Claims, 4 Drawing Sheets

METHOD FOR PERFORMING WEDGE ANALYSIS FOR ASSESSING WEDGE INSTABILITIES IN UNDERGROUND OPENINGS

TECHNICAL FIELD

The instant invention relates to wedge analysis in general and, more particularly, to a method for performing wedge analysis for assessing wedge instabilities in underground openings, such as mines, caves, and the like.

BACKGROUND ART

The stability of joint defined wedges in the backs of underground openings, such as mines, is a key concern for support design. Assessments of roof support typically demand consideration of the primary or average orientations of ubiquitous structure (sets or oriented clusters of joints or shear swarms) within the rockmass. These representative sets are then examined for mutual intersections that form wedges which, in turn, are assumed to reach a maximum dimension limited only by the span, assuming full continuity and complete ubiquity of the structure. This full-span or ubiquitous wedge analysis approach typically represents a worst-case analysis and often leads to highly conservative support design recommendations. That is, the worst-case ground support design would be based on the presumption of an existing full-span wedge, or on the largest wedge that can form across a given span from the intersection of ubiquitous structure, resulting in a design that is both overly conservative and costly.

In most cases, however, the probability of occurrence of three or more joints mutually intersecting to create a full-span wedge is low, due to the discontinuous nature of joints and the variability of spacing. In addition, any discrete wedges which do form may possess internal stability due to clamping or to tensile strength of rock bridges. This reduced likelihood of full-span wedge formation and instability is reflected in FIGS. 1A and 1B. In FIG. 1A, full-span wedge analysis predictions are shown, based on available jointing at three mine sites. These wedge analysis predictions are large steep wedges.

FIG. 1B which illustrates the actual groundfall data shows that the maximum relative wedge heights (and therefore the wedge volumes) are significantly reduced compared to those predicted by full-span wedge analysis. The reasons for this reduction include limited joint persistence and finite spacings as well as the stabilizing impact of confinement on steep wedges. See Diederichs, M. et al., Tensile Strength and Abutment Relaxation as Failure Control Mechanisms in Underground Excavations, Int. J. Rock Mech. Min. Sci. & Geomech. Abstr., vol. 36, pp. 69–96, 1999; Brady, B. et al., Rock Mechanics for Underground Mining, Chapman and Hall, 1993; and Sofianos, A., Stability of Rock Wedges in Tunnel Roofs, Int. J. Rock Mech. Min. Sci. & Geomech. Abstr., vol. 23, no. 2, pp. 119–130, 1986.

In sum, full-span ubiquitous wedge analysis tends to over-predict the support demand (capacity requirements) for underground excavations in rock. The real demand is lower due to the probability of full-span wedge formation and due to the inherent capacity of the joints.

Accordingly, a need exists for a wedge analysis method for scaling full-span wedge predictions, accounting for both occurrence and instability potential of possible wedge geometries.

A need also exists for a wedge analysis method for generating predictions for wedge failure potential and support demand to result in more economical support design for wedges to be provided in underground openings, such as mines, caves, and the like.

SUMMARY OF THE INVENTION

There is provided a method for performing wedge analysis for assessing the likelihood of wedge occurrence and instability in underground openings, such as mines, caves, and the like. The method scales full-span wedge predictions by accounting for both occurrence and instability potential of possible wedge geometries. The method allows for optimization of ground support design, which is currently based on conservative standards, through bolt length reduction or bolt pattern spacing increase, thereby reducing the overall support costs. Overall, the method generates predictions for wedge failure potential and support demand to result in more economical support design for wedges.

The method is referred to herein as the viability index approach. The viability index approach uses joint set dominance, spacing, and trace length to factor full-span predictions for wedge size, accounting implicitly for the likelihood of wedge occurrence. The viability index approach also accounts for the likelihood of wedge instability, based on joint roughness, shape and alteration, as well as wedge shape and clamping stress, to reduce the required support demand.

The viability index approach or method for performing wedge analysis for assessing wedge instabilities of wedges in an underground opening, according to the present disclosure, includes the steps of: determining an occurrence index, $I_o$, quantifying a potential for wedge formation in the underground opening for each of the wedges; determining an instability index, $I_s$, describing a potential for structurally bounded wedges of the underground opening to be unstable for each of the wedges; and determining a viability index by determining the square root of the product of the occurrence and instability indices for each of the wedges, wherein the viability index indicates a probability of failure of a wedge.

The viability index approach is a useful technique for optimizing support designs, currently based on conservative standards, through bolt length reduction or pattern spacing increase, thereby reducing operating costs.

PREFERRED EMBODIMENT OF THE INVENTION

Figure 1A:
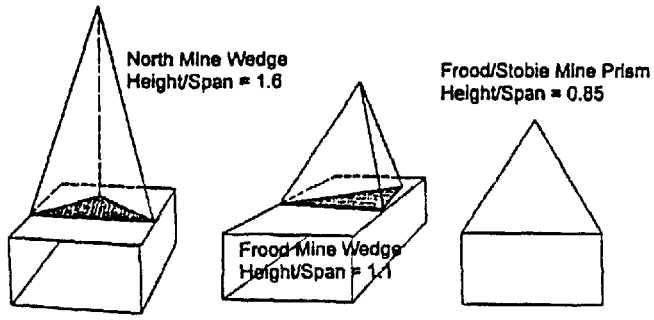
FIG. 1A illustrates prior art full-span wedge analysis predictions.
Figure 1B:
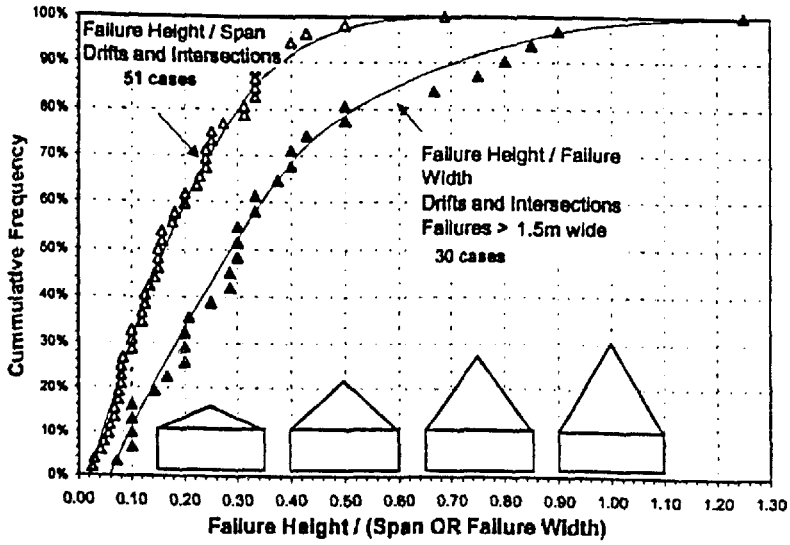
FIG. 1B is a chart illustrating that the maximum relative wedge heights are reduced compared to those predicted by full-span wedge analysis, as indicated by FIG. 1A.

A method is provided by the present disclosure for performing wedge analysis for assessing wedge instabilities in underground openings, such as mines, caves, and the like.

The method referred to herein as the viability index approach scales full-span wedge predictions by accounting for both occurrence and instability potential of possible wedge geometries. The method allows for predictions of wedge failure potential and support demand in order to provide a more economical support design for wedges.

I. Structural Data and Conventional Analysis

In order to describe the method of the present disclosure, the method is described in light of a case study where data was obtained by joint mapping in an underground mine. Since actual wedge failures are statistically insufficient in number due to the presence of dense (and potentially overly conservative) support, only the potential for wedge formation can be verified in the conditions of the case study.

As further described below, the viability index approach of the present disclosure examines the potential for predicting wedge formation by the occurrence index, $I_o$. This factor is verified by comparing the wedge occurrence predictions with actual wedges identified by rigorous back mapping and discrete wedge analysis. The accompanying instability index, $I_s$, describes the potential for existing structurally bounded wedges to be unstable and is derived from existing rockmass classification techniques, and qualitative experience.

The data of the case study is set forth by Table 1 and it summarizes joint set properties representing the joint mapping of the underground openings. The data is first analyzed according to conventional ubiquitous wedge analysis (UNWEDGE) and subsequently the data is analyzed according to the principles of the present disclosure, i.e., employing the viability index approach.

TABLE 1

Summary of joint set properties.

| SET | 1 | 2 | 3 | 4 | 5 | 6 |
|---|---|---|---|---|---|---|
| Strike | 196 | 166 | 112 | 100 | 348 | 243 |
| Dip (right) | 74 | 87 | 75 | 50 | 37 | 29 |
| Mean Spacing | 0.73 | 0.76 | 0.79 | 0.60 | 0.91 | 0.76 |
| Jr/Ja (mean) | 1.5 | 1.7 | 1.3 | 1.2 | 1.5 | 1.3 |

The joint sets are analyzed according to conventional wedge analysis in order to identify all of the combinations of three joints (out of 20 possible combinations) which form unstable wedges. After analyzing the data, twelve combinations of wedges in this example result in kinetically feasible and unstable wedges (sliding wedges with initial full-span factor of safety greater than unity are filtered out). The geometry of each of the twelve unstable wedges is used to estimate support demand for liner and bolt systems. For liner support systems the demand is equal to weight divided by perimeter, while for bolt systems the demand is equal to weight divided by area, as known in the art.

Statistics for each of the twelve identified wedges are listed in Table 2. The tabulated liner and bolt demand values shown indicate the minimum required support capacity to ensure stability (factor of safety or F.S.=1) for a span of three meters. For example, the theoretical minimum factor of safety (based on critical wedge number 123) with a demand of four tonnes per square metre for a 1.2 m×1.2 m rockbolt system providing approximately eight tonnes per square metre of distributed capacity is 2.

TABLE 2

Calculated wedge statistics for east–west trending stopes with three meter spans

| | Unstable Wedges (F.S. < 1) formed by joint sets: | | | | | | | | | | | |
|---|---|---|---|---|---|---|---|---|---|---|---|---|
| | 123 | 124 | 134 | 135 | 136 | 145 | 146 | 356 | 236 | 246 | 346 | 456 |
| Perimeter, m | 8 | 8 | 19 | 8 | 12 | 9 | 16 | 12 | 12 | 13 | 25 | 17 |
| Area, sq. m | 2.3 | 2.6 | 6.7 | 1.7 | 6.2 | 2.1 | 8.0 | 4.8 | 5.7 | 9.0 | 9.9 | 8.3 |
| Weight, tonnes | 9 | 5 | 21 | 1.5 | 10.5 | 1.5 | 9 | 5 | 9.5 | 10.5 | 15.5 | 8 |
| Height, $H_{(3)}$m | 3.3 | 2.5 | 3.3 | 0.9 | 1.9 | 0.7 | 1.0 | 1.1 | 2.7 | 1.0 | 1.3 | 0.8 |
| Bolt Demand $BD_{(3)}$ tonnes/m$^2$ | 3.9 | 1.9 | 3.1 | 0.8 | 1.7 | 0.7 | 1.1 | 1.0 | 1.7 | 1.2 | 1.6 | 1.0 |
| Liner Demand $LD_{(3)}$ tonnes/m | 1.12 | 0.63 | 1.1 | 0.18 | 0.88 | 0.17 | 0.56 | 0.41 | 0.79 | 0.79 | 0.63 | 0.47 |

While distributed bolt capacity is a key parameter, the real effectiveness of bolt systems is also limited by the bolt length. Ideally, this length should exceed the apex height of the wedge for ensured effectiveness. If this is not economically viable, then the following rule of thumb is typically applied. Bolt heights of 0.7 and 0.5 times the apex height of a wedge create 90% and 75%, respectively, effective bolting area (the relative basal area enclosing bolts which penetrate into the rockmass above the wedge). The actual factor of safety can be calculated using a discrete bolt analysis, although this procedure makes sensitivity analysis tedious. The following sub-section discusses the scaled demand approach, as known in the art, which is a more efficient approach.

II. Demand Scaling Functions

The demand values in Table 2 can be scaled for an arbitrary span S (meters) using the following formulas:

Wedge Height $H_{(s)}=(S/3\text{m})\times H_{(3)}$

Bolt Demand $BD_{(s)}=(S/3\text{m})\times BD_{(3)}$

Liner Demand $LD_{(s)}=(S/3\text{m})^2\times LD_{(3)}$ where $H_{(3)}$, $BD_{(3)}$, $LD_{(3)}$ refer to demand for a three-meter span (Table 2).

III. Viability Index Approach

The viability index approach which determines a viability index, $I_v$, according to the present disclosure, will now be described in order to factor the full-span demand estimates to obtain more probable or viable demand targets for design. The viability index is defined as the square root of the product of the occurrence and instability indices:

$$I_v=(I_oI_s)^{0.5}$$

The viability index can be interpreted as a qualitative index for the probability of failure of a full span wedge, or as the ratio of the most probable wedge dimension S*, to the span, S, of the underground opening (effective span: $S^*=S\text{x}I_v$).

The occurrence index, $I_o$, characterizes the potential for wedge occurrence. It is the product of factors for joint set dominance, length and spacing and is calculated as follows:

$$I_o=(F_DF_LF_S)/1000$$

The joint set dominance factor, $F_D$, is based on the relative dominance or importance of each joint set and is calculated as the sum of the following pre-set or pre-designated values for each of the three joint sets. The joint set dominance factor, $F_D$, is determined subjectively through visual observation, such that dominant joint sets are clearly discernable structural features in an underground heading:

| Joint Dominance | Most Dominant (1 set only) | Dominant Always Present | Intermediate Frequently Present | Minor/ Random Typically Absent |
|---|---|---|---|---|
| Dominance Factor, $F_D$ | 4 | 3 | 2.5 | 1.5 |

The joint length factor, $F_L$, accounts for the joint trace length as exposed in the roof of the underground opening or mine. Preferably, the value corresponding to the 80% cumulative frequency (80% of traces smaller than this value) is used. The factor $F_L$ is calculated as the sum of the following pre-set or pre-designated values for each of the three joint sets:

| Joint Trace Length | Shears, bedding | >1.5x span or 0 ends visible | 0.5–1.5x span or 1 end visible | 0.2–0.5x span or 2 ends visible | <0.2x span |
|---|---|---|---|---|---|
| Length Factor, $F_L$ | 4 | 3 | 2.5 | 2 | 1 |

The joint spacing factor, $F_S$, is based on the representative average spacings for each of the joints that make up the wedge. The factor FS is calculated as the sum of the following pre-set or pre-designated values for each of the three joint sets:

| Joint Spacing | <0.1x span | 0.1–0.25x span | 0.25–0.5x span | 0.5–1.5x span | >1.5x span |
|---|---|---|---|---|---|
| Spacing Factor, $F_S$ | 3.3 | 3 | 2.5 | 2 | 1 |

The instability index, $I_s$, characterizes failure potential of a wedge and is the product of three factors described below:

$$I_s=(F_JF_GF_C)/1000$$

The joint factor, $F_J$, is based on the frictional, dilational and cohesional strength properties of the joints that form each wedge. It is determined by the median of Jr/Ja, Barton, N. et al., Engineering Classification of Rock Masses for Design of Tunnel Support, Rock Mech., vol. 6, no. 4, pp. 189–239, 1974, for the critically oriented joint in the wedge, or for the joint with the lowest Jr/Ja:

| Jr/Ja | <0.1 | 0.1–0.3 | 0.3–0.6 | 0.6–1 | 1–1.5 | 1.5–2.5 | 2.5–4 | >4 |
|---|---|---|---|---|---|---|---|---|
| Joint Factor, $F_J$ | 10 | 9 | 8 | 7 | 6 | 5 | 4 | 3 |

The gravity factor, $F_G$, accounts for the effect of sliding. For sliding wedges this is partially taken into account by eliminating those wedges with a factor of safety above unity. However, the effect of stress and geometric clamping (not considered by limit equilibrium calculations) is increased when one or more joint surfaces are inverted (the wedge is partially sliding):

| Wedge Behavior | Free Falling | Falling with 1 joint or edge vertical | Falling-Sliding with 1 Near-vert. Joint inverted | Pure Sliding no rotation |
|---|---|---|---|---|
| Gravity Factor, $F_G$ | 10 | 9 | 7 | 4 |

The clamping factor, $F_C$, is based on the clamping effect of compressive stresses found above most drift backs. Due to dilation, which must take place to liberate wedges, and due to the self-stabilizing effect of such joint dilation, many steep wedges cannot become free-falling unless severe relaxation takes place. See Crawford, A. et al., Influence of the Insitu Stress Field and Joint Stiffness on Rock Wedge Stability in Underground Openings, Canadian Geotech. J., vol. 20, pp. 276–287, 1983. This factor is determined by the ratio of wedge height to span, and by the state of tangential stress in the back:

| Wedge Height/ Span | 2+ | 2–1.1 | 1.1–0.7 | 0.7–0.5 | 0.5–0.3 | <0.3 |
|---|---|---|---|---|---|---|
| Wedge ACone@ Angle | <15E | 15–25E | 25–35E | 35–45E | 45–60E | >60E |
| Stress State | Clamping Factor, $F_C$ | | | | | |
| Moderate to High Stress | 1 | 3 | 6 | 8 | 9 | 10 |
| Low to Zero Stress | 5 | 7 | 8 | 9 | 10 | 10 |
| Tensile/ Open Joints | 8 | 9 | 10 | 10 | 10 | 10 |

IV. Application of the Viability Index

The use of the above indices is summarized below:

1. Perform a ubiquitous wedge analysis (UNWEDGE), as known in the art (section I), using a standard span, e.g., 3 m.
2. List weight, height, perimeter and base area for all wedges with F.S.<1.0 (Table 2).
3. Obtain the standard (index) span demand values $H_{(3)}$, $BD_{(3)}$, $LD_{(3)}$ at the index span of 3 m for all wedges (section II and Table 2).
4. Select a desired span, S, for the design case in question (section II).

5. Multiply the viability index, $I_v$, by the actual span, S, to obtain the effective span, S*, for all wedges (section III).
6. Apply the effective span, S*, to obtain effective bolt heights for all wedges.

Viable Wedge Height, $H_{(S)}$, for effective span, S*, equals $(S^*/3\ m)\times H_{(3)}$ 7. Use S* instead of S to obtain the effective bolt and liner demand values for all wedges.

Viable Bolt Demand, $BD_{(s)}$, for effective span, S*, equals $(S^*/3\ m)\times BD_{(3)}$ Viable Liner Demand, $LD_{(s)}$, for effective span, S*, equals $(S^*/3\ m)^2\times LD_{(3)}$ 8. Apply an appropriate value for the factor of safety to the demand and height requirements for all wedges.

V. Viability Factors for the 153 Stopes

The viability parameters as determined by the case study for each joint set identified above are listed in Table 3. For example, in the case study, it was determined that joint set 1 is the most dominant joint set, and, therefore, it was assigned a dominance factor of 4; it was determined that joint set 1 has a joint trace length of 0.5–1.5×span, and, therefore, it was assigned a length factor of 2.5; and it was determined that joint set 1 has a joint spacing of 0.1–0.25× span, and, therefore, it was assigned a spacing factor of 3.

TABLE 3

Viability parameters for individual joint sets

| | Set 1 | Set 2 | Set 3 | Set 4 | Set 5 | Set 6 |
|---|---|---|---|---|---|---|
| Dominance Factor, $F_D$ | 4 | 2.5 | 3 | 2.5 | 3 | 1.5 |
| Length Factor, $F_L$ | 2.5 | 3 | 3 | 4 | 3 | 3 |
| Spacing Factor, $F_S$ | 3 | 2.5 | 2.5 | 3 | 2.5 | 2.5 |
| Joint Factor, $F_J$ | 5.5 | 6 | 6.5 | 6 | 7 | 6.5 |

The viability indices for each wedge are listed in Table 4. It is noted that a wedge is formed by taking three joint sets, e.g., wedge number 123 includes joint sets 1, 2 and 3. Hence, for example, as indicated by Table 4, the dominance factor for wedge number 123 is obtained by adding the dominance factor parameters (Table 3) of joint sets 1, 2 and 3 to obtain 9.5. The same method is used to determine the dominance factor for the other wedges, and the length and spacing factors for all wedges.

TABLE 4

Viability factors, and occurrence, instability and viability indices for wedges

| Wedge | 123 | 124 | 134 | 135 | 136 | 145 | 146 | 356 | 236 | 246 | 346 | 456 |
|---|---|---|---|---|---|---|---|---|---|---|---|---|
| Dominance, $F_D$ | 9.5 | 9 | 9.5 | 10 | 8.5 | 9.5 | 8 | 7.5 | 7 | 6.5 | 7 | 7 |
| Length, $F_L$ | 8.5 | 9.5 | 9.5 | 8.5 | 8.5 | 9.5 | 9.5 | 9 | 9 | 10 | 10 | 10 |
| Spacing, $F_S$ | 8 | 8.5 | 8.5 | 8 | 8 | 8.5 | 8.5 | 7.5 | 7.5 | 8 | 8 | 8 |
| Joint, $F_I$ | 6.5 | 6 | 6.5 | 7 | 6.5 | 7 | 6.5 | 7 | 6.5 | 6.5 | 6.5 | 7 |
| Gravity, $F_G$ | 9 | 9 | 7 | 9 | 7 | 9 | 7 | 10 | 10 | 10 | 7 | 10 |
| Clamping, $F_C$ | 3 | 7 | 4 | 10 | 8 | 10 | 9.5 | 9 | 8 | 9.5 | 9 | 10 |
| Occurrence Index, $I_O$ | 0.65 | 0.73 | 0.77 | 0.68 | 0.58 | 0.77 | 0.65 | 0.51 | 0.47 | 0.52 | 0.56 | 0.56 |
| Instability Index, $I_S$ | 0.18 | 0.38 | 0.18 | 0.63 | 0.36 | 0.63 | 0.43 | 0.63 | 0.52 | 0.62 | 0.41 | 0.70 |
| Viability Index, $I_V$ | 0.34 | 0.52 | 0.37 | 0.65 | 0.46 | 0.70 | 0.53 | 0.56 | 0.50 | 0.57 | 0.48 | 0.63 |

Figure 2:
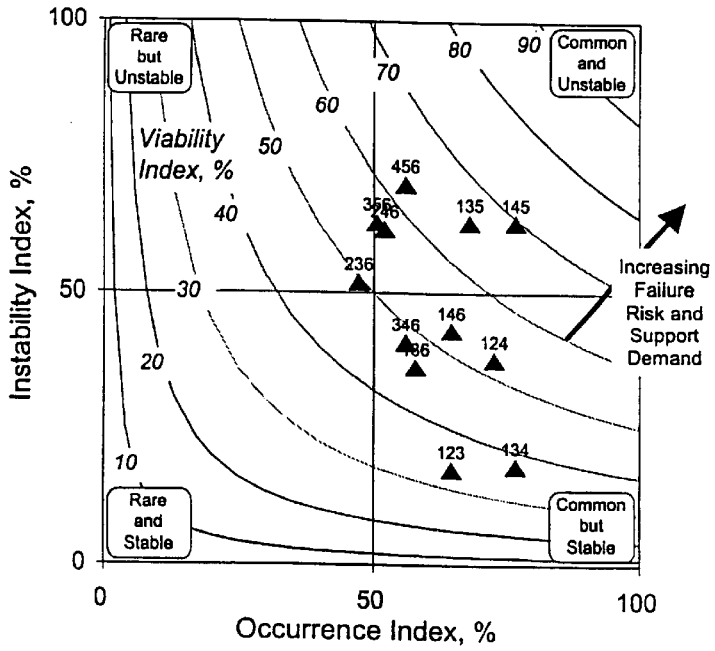
FIG. 2 is a chart illustrating occurrence, instability and viability indices according to the present disclosure for a particular mine.

FIG. 2 illustrates the relationship between occurrence and instability potentials and the viability index. Each quadrant has been labeled according to the wedge being rare or common, and unstable or stable. The wedges which are most critical are the wedges which fall within the top right quadrant, i.e., common and unstable. These wedges have occurrence and instability indices above 0.50 or 50%.

A factor of safety can be applied (F.S. x effective span, S*). This factor is calculated such that all demand values are scaled relative to the Amost viable worst-case@. This is done by using, as the implied factor of safety, the value which must be multiplied by the largest viability index (e.g., 0.7 for wedge number 145) in order to obtain the value of unity (e.g., 1.4×0.7=1). Apply this factor (in this particular example, 1.4×S*) to all other wedges.

Figure 3:
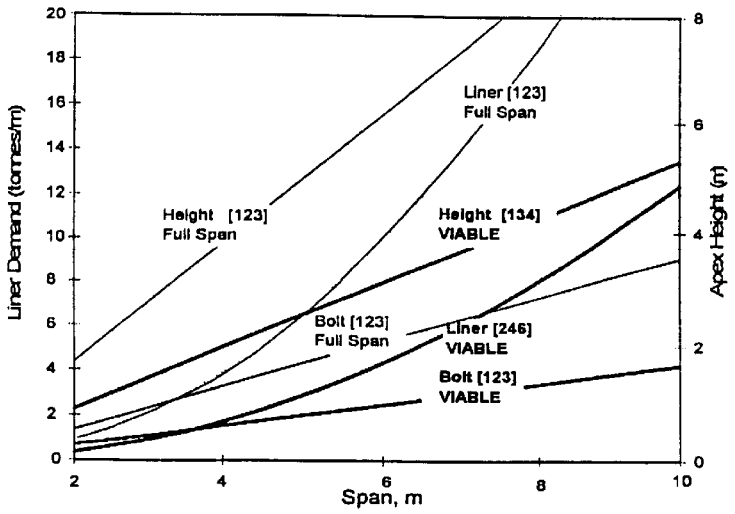
FIG. 3 is a chart illustrating scaled design demand curves based on a viability index wedge analysis approach according to the present disclosure.

The scaled design demand curves based on the complete viability index ($S^*=I_v xS$) for the 12 wedges are illustrated by FIG. 3. A factor of safety of 1.4 has been applied to the curves. It is noted that the application of the viability index can result in a different critical wedge (e.g., wedge number 123 is critical for liner demand when full-span is used, while wedge number 246 is critical after viability adjustment).

V. Verification

Only the occurrence index of the viability index can be verified in the field by performing a discrete wedge stability analysis for all the stopes. This was done for the case study area by mapping the joints in the stope back in detail and discretely analyzing for joint intersections forming wedges capable of moving into the opening. Wedges sliding on a surface shallower than 50 degrees were excluded. The remainder were treated as gravity wedges for demand analysis. The apex heights and the respective bolt and liner demands were calculated for each discrete wedge in the data set.

Figure 4A:
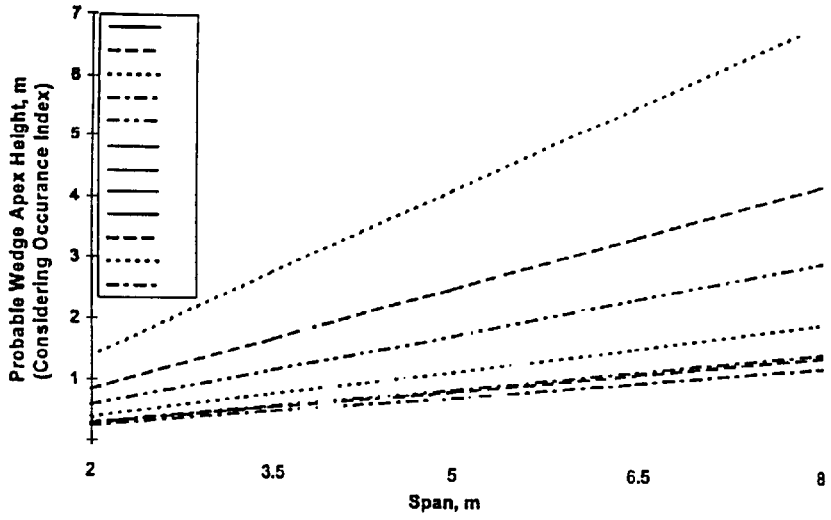
FIGS. 4A–4C are charts illustrating apex height, bolt demand, and liner demand obtained from occurrence index predictions compared to analysis of actual wedges using the principles of the present disclosure.
Figure 4B:
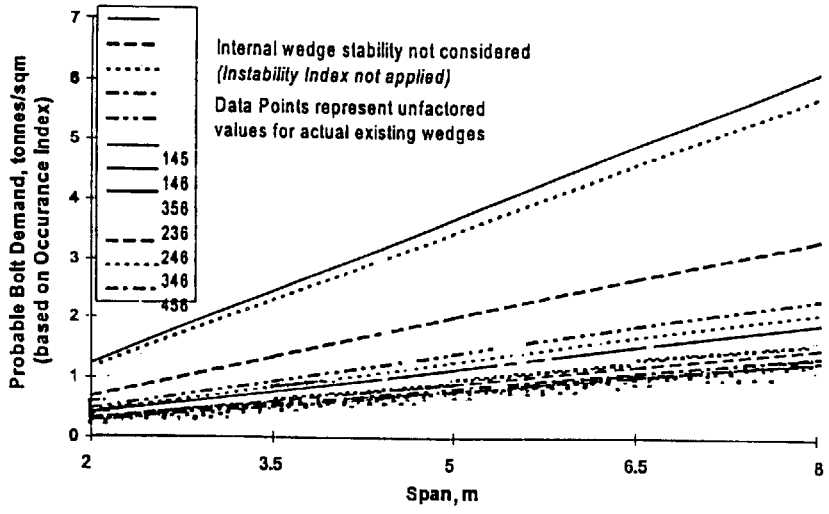
Figure 4C:
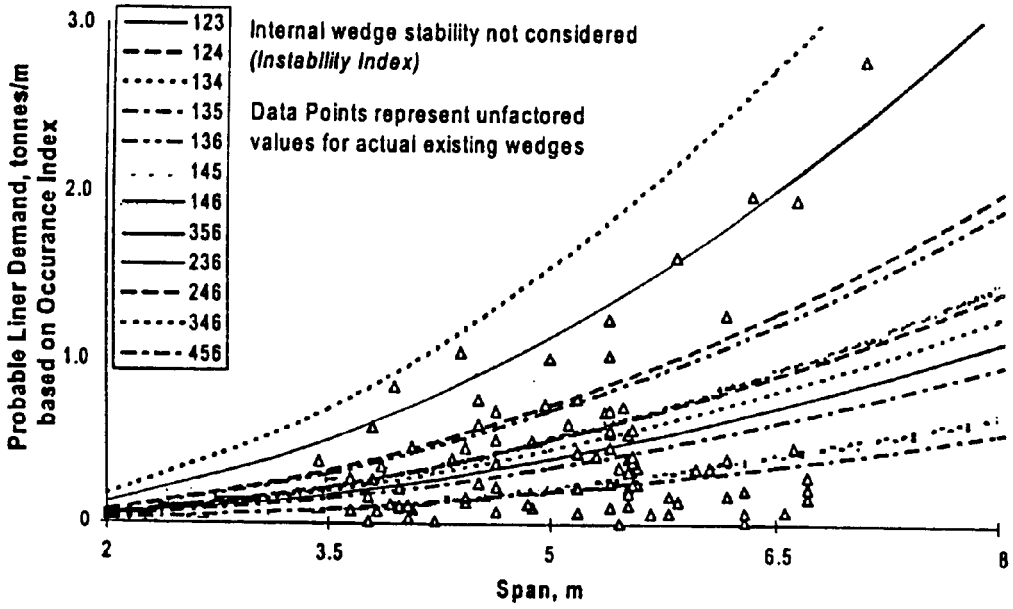

In all, 90 wedges were identified and used for verification of the occurrence index (see FIGS. 4A–4C). It is not possible from discrete mapping to verify the instability index. This requires a detailed database of wedge failures and identified stable wedges.

The instability index is based on accepted logic found in other classification schemes, on commonly encountered wedge fall scenarios in mine excavations and on investigations into the effects of residual joint strength, clamping and relaxation. See, e.g., Diederichs, M. et al.

FIGS. 4A–4C compare the predicted demands based on applying the occurrence index to the ubiquitous wedge predictions (the instability index has not been applied), and the calculated demand parameters (unfactored) for actual wedges identified in the case study area.

While the unfactored full-span demand analysis (Table 2 and FIG. 3) tends to overestimate the real demand associated with wedges in the back, the factored demand predictions based on the occurrence index are sufficient to account for 99%, 97% and 100%, respectively, of actual wedge heights, bolt demands and liner demands without the requirement for excess support. Spans greater than 5 m in this case may also involve intersections that, due to their three-dimensional nature, lead to larger wedges and should be considered separately for support design.

In conclusion, conventional full-span ubiquitous wedge analysis tends to over-predict the support demand (capacity requirements) for underground excavations in rock. The real demand is lower due to the low probability for full-span wedge formation and due to the inherent capacity of the joints, both of which are aspects not normally considered in conventional support design for wedges. The viability index approach of the present disclosure provides a method to account for these factors in design, resulting in more efficient support systems in underground openings, mining openings or temporary works.

It is contemplated that the viability index approach is programmed as a set of instructions which are stored within at least one memory. Accordingly, at least one processor connected to the at least one memory is configured for receiving and executing the set of instructions for wedge data inputted by a user.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method for performing wedge analysis for assessing wedge occurrence and instability in an underground opening, said method comprising the steps of:

determining an occurrence index quantifying a potential for wedge formation in the underground opening for each of the wedges;

determining an instability index describing a potential for structurally bounded wedges of the underground opening to be unstable for each of the wedges; and determining a viability index by determining the square root of the product of the occurrence and instability indices for each of the wedges, wherein the viability index indicates a probability of failure of a wedge.

2. The method according to claim 1, wherein the step of determining the occurrence index for each of the number of wedges comprises the following steps for each of the wedges:

determining a joint set dominance factor;

determining a joint trace length factor;

determining a joint spacing factor; and multiplying the joint set dominance, joint trace length and joint spacing factors and dividing the product by 1000.

3. The method according to claim 2, wherein the step of determining the joint set dominance factor comprises the steps of:

assigning a dominance parameter from a table of dominance parameters to each joint set forming the wedge, where the dominance parameter identifies a joint set's dominance; and summing each dominance parameter corresponding to each joint set forming the wedge.

4. The method according to claim 2, wherein the step of determining the joint trace length factor comprises the steps of:

assigning a length parameter from a table of length parameters to each joint set forming the wedge, where the length parameter identifies a joint sets joint trace length as exposed in the underground opening; and summing each length parameter corresponding to each joint set forming the wedge.

5. The method according to claim 2, wherein the step of determining the joint spacing factor comprises the steps of:

assigning a spacing parameter from a table of spacing parameters to each joint set forming the wedge, where the spacing parameter represents average spacings for a joint set; and summing each spacing parameter corresponding to each joint set forming the wedge.

6. The method according to claim 1, wherein the step of determining the instability index for each of the wedges comprises the following steps for each of the wedges:

determining a joint factor;

determining a gravity factor;

determining a clamping factor; and multiplying the joint, gravity and clamping factors and dividing the product by 1000.

7. The method according to claim 6, wherein the step of determining the joint factor comprises the steps of:

assigning a joint parameter from a table of joint parameters to each joint set forming the wedge, where the joint parameter is based on frictional, dilational and cohesional strength properties for a joint set; and selecting as the joint factor the joint parameter of the joint set with the lowest Jr/Ja.

8. The method according to claim 6, wherein the step of determining the gravity factor comprises the step of:

determining the gravity factor from a table of gravity factors for each wedge according to sliding characteristics of the wedge.

9. The method according to claim 6, wherein the step of determining the clamping factor comprises the step of:

determining the ratio of wedge height to span, and the state of tangential stress in a drift back of the wedge; and assigning the clamping factor from a table of clamping factors to each wedge corresponding to the determined ratio of wedge height to span and the state of tangential stress in the drift back of the wedge.

10. The method according to claim 1, further comprising the steps of:

selecting a desired span;

multiplying the viability index by the desired span to obtain an effective span for each of the wedges;

determining effective bolt heights by dividing the effective span by an index span and multiplying the quotient by a standard span demand value representing a bolt height at the index span for each of the wedges;

determining an effective bolt demand value by dividing the effective span by the index span and multiplying the quotient by a standard span demand value representing a bolt demand value at the index span for each of the wedges; and determining an effective liner demand value by dividing the effective span by the index span and multiplying the quotient by a standard span demand value representing a liner demand value at the index span for each of the wedges.

11. The method according to claim 10, further comprising the steps of:

determining an implied factor of safety which when multiplied by the largest viability index of all the wedges the product is approximately equal or equal to one; and scaling all demand values for each of the number of wedges by a factor of safety equal to the effective span multiplied by the implied factor of safety.

12. The method according to claim 1, further comprising the steps of:

plotting the viability index for each of the wedges; and determining which wedges have a high potential of occurring and a high potential for being unstable.

13. The method according to claim 1, further comprising the steps of:

implementing the steps as a set of instructions;

storing the set of instructions within at least one memory;

executing the set of instructions using at least one processor connected to the at least one memory.

* * * * *